US006932399B2

(12) United States Patent
Fonfrias

(10) Patent No.: US 6,932,399 B2
(45) Date of Patent: Aug. 23, 2005

(54) CANINE WASTE RECEPTACLE

(76) Inventor: Richard Salvatore Fonfrias, 316 E. 55th St., Suite 3F, New York, NY (US) 10022

( * ) Notice: Subject to any disclaimer, the term of this patent is extended or adjusted under 35 U.S.C. 154(b) by 0 days.

(21) Appl. No.: 10/157,194

(22) Filed: May 30, 2002

(65) Prior Publication Data

US 2003/0222465 A1 Dec. 4, 2003

(51) Int. Cl.[7] ..... A01K 29/00
(52) U.S. Cl. ..... 294/1.3; 229/117.12
(58) Field of Search ..... 294/1.3–1.5, 25, 294/55; 15/104.8, 257.1, 257.2, 257.6; 229/117.12; 383/7, 23

(56) References Cited

U.S. PATENT DOCUMENTS

| | | | | |
|---|---|---|---|---|
| 2,649,604 A | | 8/1953 | Hess | |
| 2,964,227 A | | 12/1960 | Goldshall | |
| 3,676,887 A | | 7/1972 | Klein | |
| 3,885,266 A | | 5/1975 | Nafziger | |
| 3,971,503 A | | 7/1976 | Allan | |
| 4,103,952 A | | 8/1978 | Thompson | |
| 4,138,153 A | | 2/1979 | Brown | |
| 4,222,598 A | | 9/1980 | Ullger | |
| 4,272,116 A | | 6/1981 | Tufte | |
| 4,458,932 A | | 7/1984 | Resch | |
| 4,747,633 A | * | 5/1988 | Stacy | 294/1.3 |
| 4,752,093 A | | 6/1988 | Haber | |
| 5,020,185 A | | 6/1991 | Hoefler | |
| 5,039,148 A | | 8/1991 | Brautovich | |
| 5,186,384 A | | 2/1993 | Nelson | |
| 5,301,870 A | * | 4/1994 | Smith et al. | 229/402 |
| 5,564,762 A | | 10/1996 | Ring | |
| 5,584,519 A | | 12/1996 | Myles | |
| 5,797,636 A | | 8/1998 | Hamynen | |
| 5,964,488 A | * | 10/1999 | Bedel | 294/1.3 |
| D418,261 S | | 12/1999 | Betts | |

FOREIGN PATENT DOCUMENTS

| | | | | |
|---|---|---|---|---|
| DE | 3518-908 | * | 11/1986 | 294/1.3 |
| DE | 4127108 | * | 2/1993 | 294/1.3 |
| FR | 2698113 | * | 5/1994 | 294/1.3 |
| GB | 2208588 A | | 4/1989 | |

* cited by examiner

*Primary Examiner*—Dean J. Kramer
(74) *Attorney, Agent, or Firm*—Charles D. Miller

(57) ABSTRACT

A waste receptacle particularly useful for scooping-up and removing canine waste and a blank for making the receptacle. The blank and receptacle are made from a single thin sheet of material such as cardboard. The receptacle can be used with only one hand. It is stored and transported nearly flat and can be popped into operative configuration by applying pressure on the sides. Further application of pressure on the sides changes the size and shape of the receptacle opening and controls the position of a flap over the opening for more control of the scooping and closing process. A hook structure is formed on one end of the receptacle. The receptacle has a tapered shape which allows use and control of the receptacle by people with large or small hands.

27 Claims, 15 Drawing Sheets

CANINE WASTE RECEPTACLE

FIELD OF THE INVENTION

The invention relates to devices and methods for removal of waste and, in particular, to articles useful for sanitary pickup and disposal of animal waste.

BACKGROUND

Within Urban or Suburban populations, the ownership of dogs has increased and the necessity for the removal of pet excrement has been and continues to be a problem In densely populated areas, particularly urban areas, removal of pet excrement has created public health and environmental concerns, consequently, local governments have passed ordinances making it mandatory to remove the excrement and dispose of it in an environmentally health manner.

Dog owners faced with an obligation to remove, and properly dispose of this waste, have approached the problem in a variety of ways, most commonly by the use of non-bought items, that is, items which were not designed or sold to be used as waste receptacles. One consistently practiced method for removal involves the use of a plastic bag. To remove excrement the pet owner turns a plastic bag inside out, inserts a hand into the reversed bag and places this bag onto the excrement so that the plastic bag is between the inserted hand and the excrement. Through the thin material of the bag, the excrement is grabbed and picked-up. While holding onto the excrement, the free hand must pull the edges of the bag over the hand holding the excrement, thus restoring the bag to its normal outside out condition with the excrement inside the bag.

This process has several distinct drawbacks. First, it's clearly a two hand operation. It takes two hands to turn the bag inside out, two hands to insert the pickup hand into the inside-out bag and two hands to restore the inside-out bag to its normal condition of outside-out. Second, the thin bag allows the texture, the warmth and the general feel of the animal deposit to be transmitted to the hand of the person, creating an unpleasant experience.

The widespread use of non-bought items such as plastic bags, and newspapers to remove and dispose of pet excrement may be due to the fact that currently there exists no one product that effectively, efficiently and economically enables removal of pet excrement and that is easily operable using only one hand.

A variety of other devices have been tried but a need still exists for an inexpensive device operable by one hand.

SUMMARY OF INVENTION

The instant invention solves these problems by use of a waste receptacle having a scoop at one end and a hook at the opposite end. One embodiment of the receptacle is made from a single sheet of thin flexible material. A blank is formed from the material. The blank is folded and one side is affixed to a second side. A pair of hooks are formed at one end of the receptacle. A scoop and a flap are formed at the opposite end of the receptacle. In a first configuration the receptacle is folded into a near flat device.

In this configuration, the receptacle is easily stacked meaning that large numbers of them can be stored in a relatively small space. To convert the near flat device into a second configuration for use, pressure is applied to the sides of the device. This pressure causes a central space to be created between the walls of the receptacle. It also causes an upper flap to snap down into a position over the opening to the central space at the scoop end of the receptacle. Subsequent applications of pressure along the sides of the receptacle allow the user to control the position of the flap over the opening creating a larger or smaller or blocked entrance to the receptacle depending upon the amount of pressure applied. This enables a user to apply relatively more pressure to create a large entrance while scooping-up the excrement. Once the excrement is inside the receptacle the pressure can be released and the flap will automatically move into a position blocking the entrance to the receptacle and blocking the excrement inside the receptacle. To completely enclose the excrement once it is inside the receptacle a user can press the scoop against a rigid object such as the ground and increase the applied pressure causing the scoop to fold up and into a position totally blocking the receptacle entrance.

The receptacle has a Hook structure at its end opposite the scooping end. This structure permits a user to attach the receptacle to an external object such as a dog leash.

In a second embodiment, the flap has a tab which interlocks with the scoop when the scoop is folded-up. In this embodiment, the flap is comparatively shorter than the flap of the first embodiment.

In another embodiment the receptacle is formed of plastic and is directly molded into a receptacle.

It is an object of this invention to provide a canine waste receptacle which is operable using only one hand. It is also an object to provide a canine waste receptacle which can be readily transported by a user.

It is also an object of this invention to provide a canine waste receptacle which can be easily converted from a near flat configuration suitable for transport into another configuration suitable for scooping using one hand.

It is further an object to provide a canine waste receptacle where the user can control the size and shape of an opening into the receptacle using only one hand.

DETAILED DESCRIPTION

Figure 1:
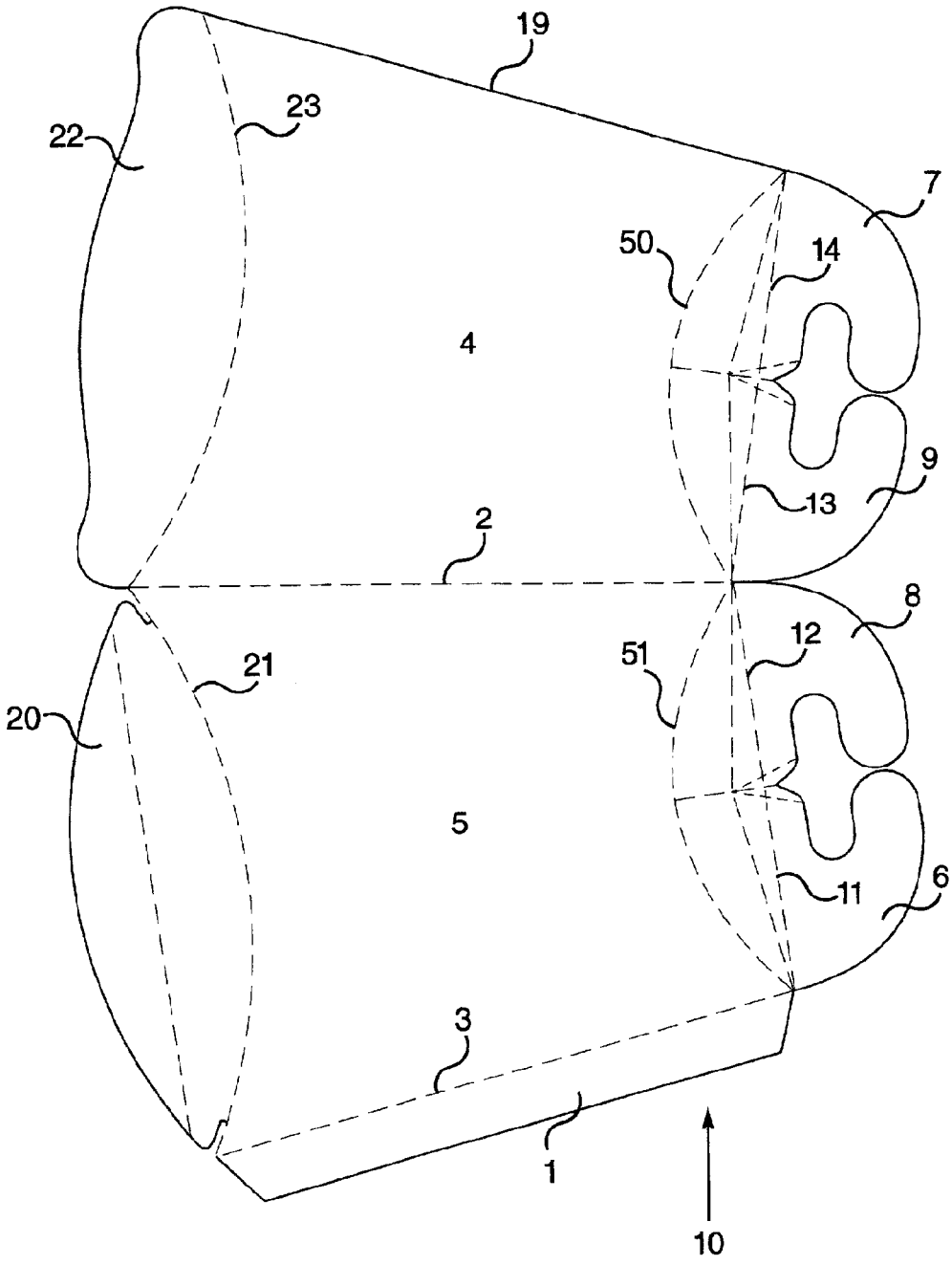
FIG. 1 is a blank for a receptacle.
Figure 10:
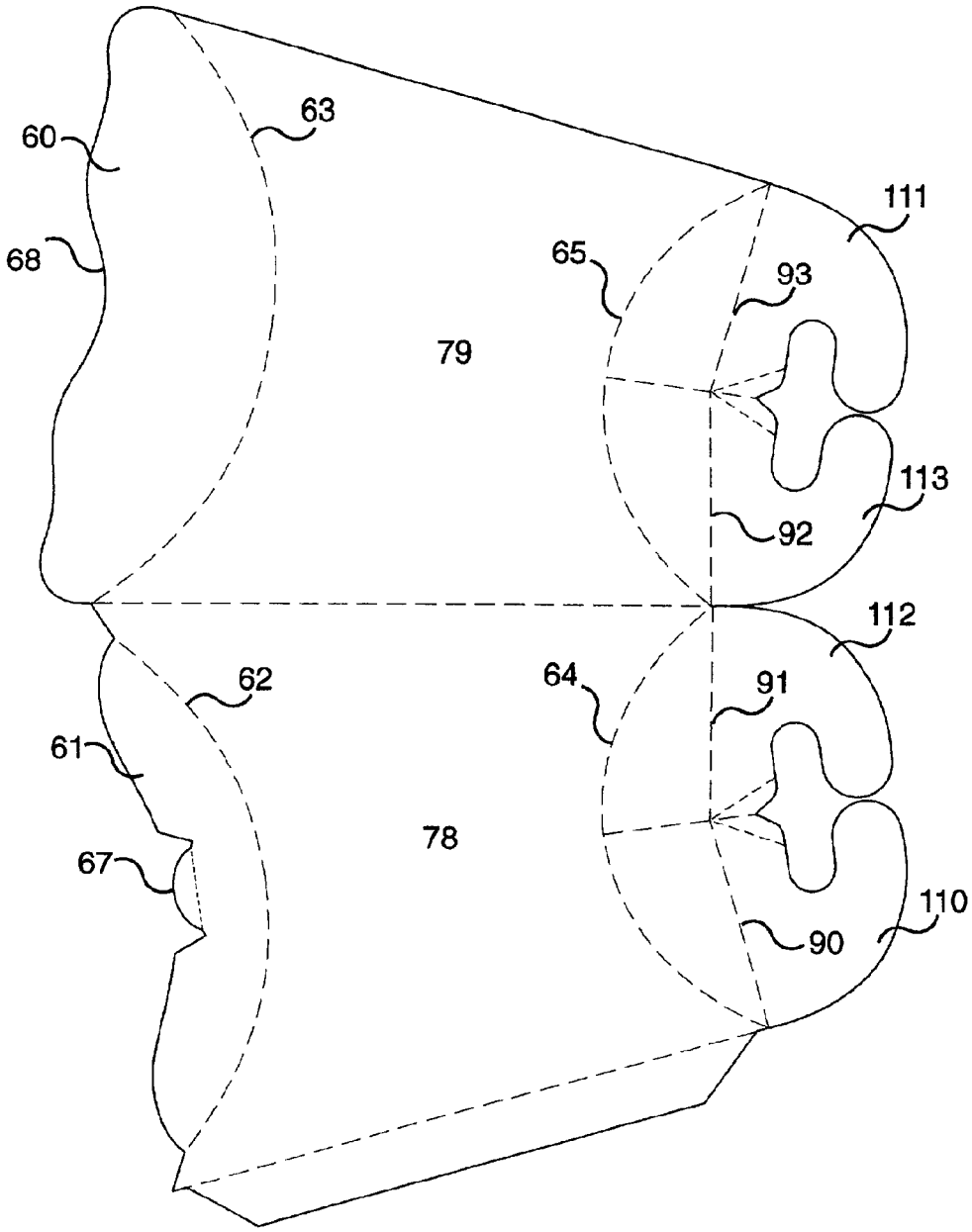
FIG. 10 is a blank for a third embodiment of a receptacle.

The invention is preferably made from a single piece of sheet material such as cardboard. In one implementation, it was formed from 10 point SBS board but can be formed from any suitable thin sheet material. FIG. 1 shows an example of a blank, item 10 formed of sheet material from which a receptacle is to be constructed. FIGS. 1 and 10 are in a die strike format where dashed lines indicate score lines or fold lines. Elsewhere in this specification dashed lines are used in their normal sense. Item 1 in FIG. 1 is a glue tab. Item 3 is a fold line for glue tab 1. Fold line 2 divides the blank 10 into a first side or wall indicated by 4 and a second side or wall indicated by 5. To form blank 10 into a receptacle glue tab 1 is folded along line 3 so that it is under wall 5 of blank 10. Blank 10 is folded along line 2 so that the bottom of side 4 is flat against and facing the bottom of side 5. The top of glue tab 1 which is folded under side 5 will also be facing the folded over bottom and will be adhered to the bottom of side 4 with adhesive producing a near flat construction as shown in outline in FIGS. 2 and 3.

It should also be noted that alternatively the bottom of glue tab 1 could be adhered to the top of side 4 so that the glue flap would appear on the outside of the finished receptacle.

Figure 17:
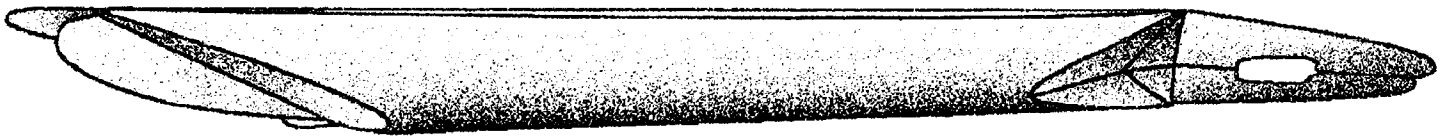
FIG. 17 is a perspective view of a receptacle in a near flat configuration.

As can be seen wall 4 is connected to wall 5 along fold line 2 and along fold line 3. In a preferred embodiment the width of wall 5 between lines 2 and 3 is slightly smaller than the corresponding width between lines 2 and 19 of wall 4 at any particular location on the wall. The difference in width is so small that it is not apparent in the drawing figures. This slight difference in the widths of the walls causes a slight bias in the flexible material of the walls when the blank is formed into a receptacle so that the receptacle will be in a near flat configuration as opposed to being in a completely flat configuration. See FIG. 17. The bias will cause a very slight bowing of the walls and in the absence of any external force being applied to the receptacle, the inner side of the wall 4 will be slightly out of contact with the inner side of wall 5. Wall 5 may also be affixed to wall 4 by any appropriate means other than adhesive although use of adhesive is preferred.

Regardless of the method used to make the receptacle, to achieve the near flat configuration one of the two finished walls, measured from edge to edge of the finished receptacle, must be slightly wider than the other finished wall at corresponding points on the wall. For instance, the (sides) walls could be made of equal width on the blank and the difference in the width of the walls of the finished receptacle could be achieved by adjusting the position of the glue tab 1 on side 4. If the finished receptacle is formed in plastic by blow molding, one wall measured from edge to edge would be made slightly wider than the other wall in the design of the mold.

Items 6, 7, 8 and 9 are used to form the hanger portion of the scoop. When side 4 is folded along fold line 2 onto side 5 one side of item 6 is folded into contact with a corresponding side of item 7. Also, one side of item 8 is folded into contact with a corresponding side of item 9.

Item 6 is glued, or otherwise adhered, to item 7. The glue or other adhesive does not extend beyond crease lines item 11 and 14 in a preferred embodiment. This process creates a portion of the hanger identified as item 15 in FIG. 2. Item 15 is of two layer construction providing added rigidity and durability. In a similar manner item 8 is glued or otherwise adhered to item 9. The adhesive does not extend beyond crease lines 12 and 13. This process creates another portion of the hanger identified as item 16 in FIG. 2. Like item 15, the resulting item 16 is of double layer construction, the two layers being adhered together. Here also the two layers adhered together provides added rigidity and increases the durability and strength of the hanger portion.

After the blank has been folded and glued it is in a flat or near flat configuration. In this configuration it can easily be stored and transported. Since it is flat or near flat and is substantially only two layers of sheet material thick, multiple receptacles can be stacked and packed in a small space.

Figure 2:
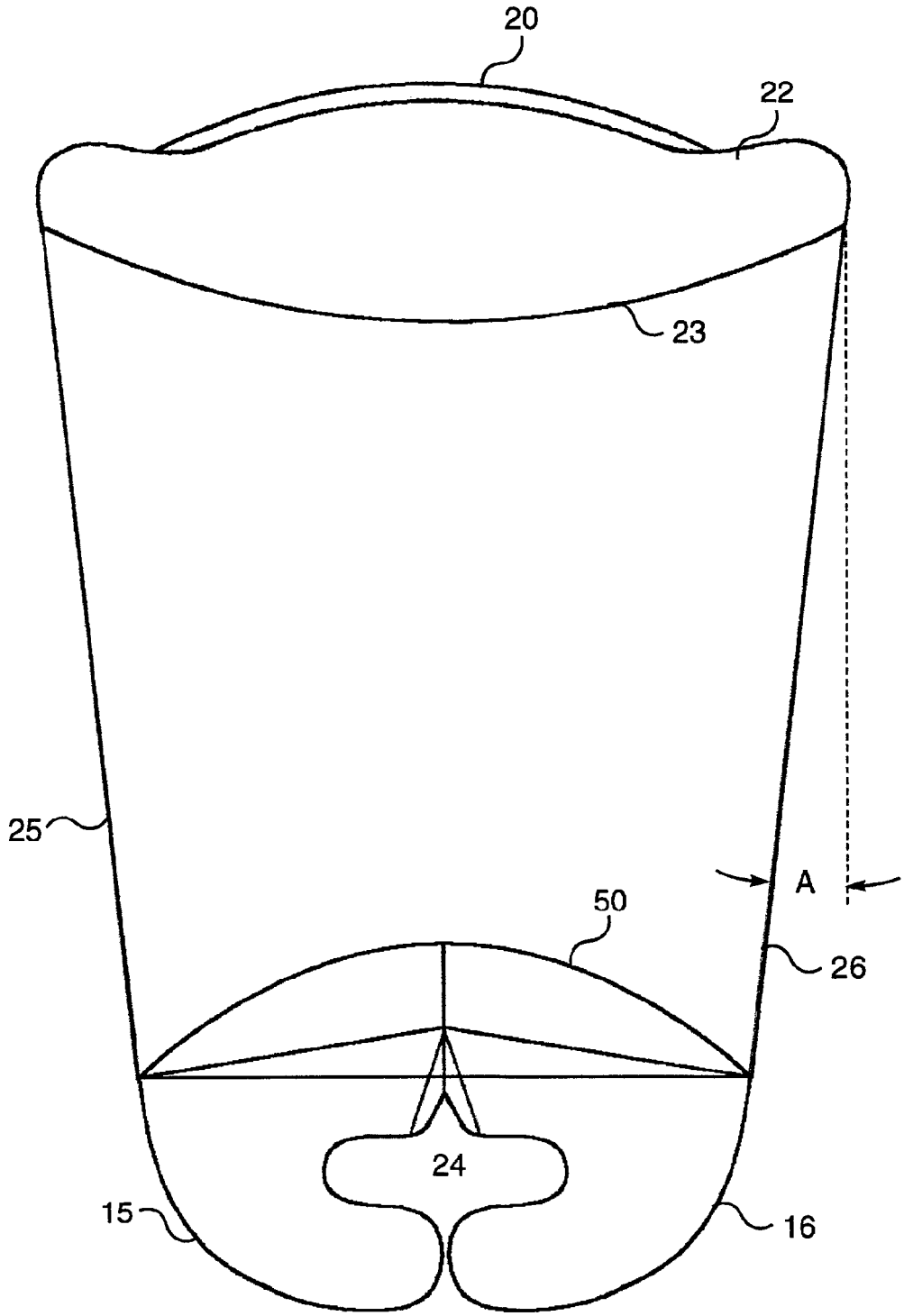
FIG. 2 is a bottom view of a receptacle in its near flat configuration.
Figure 3:
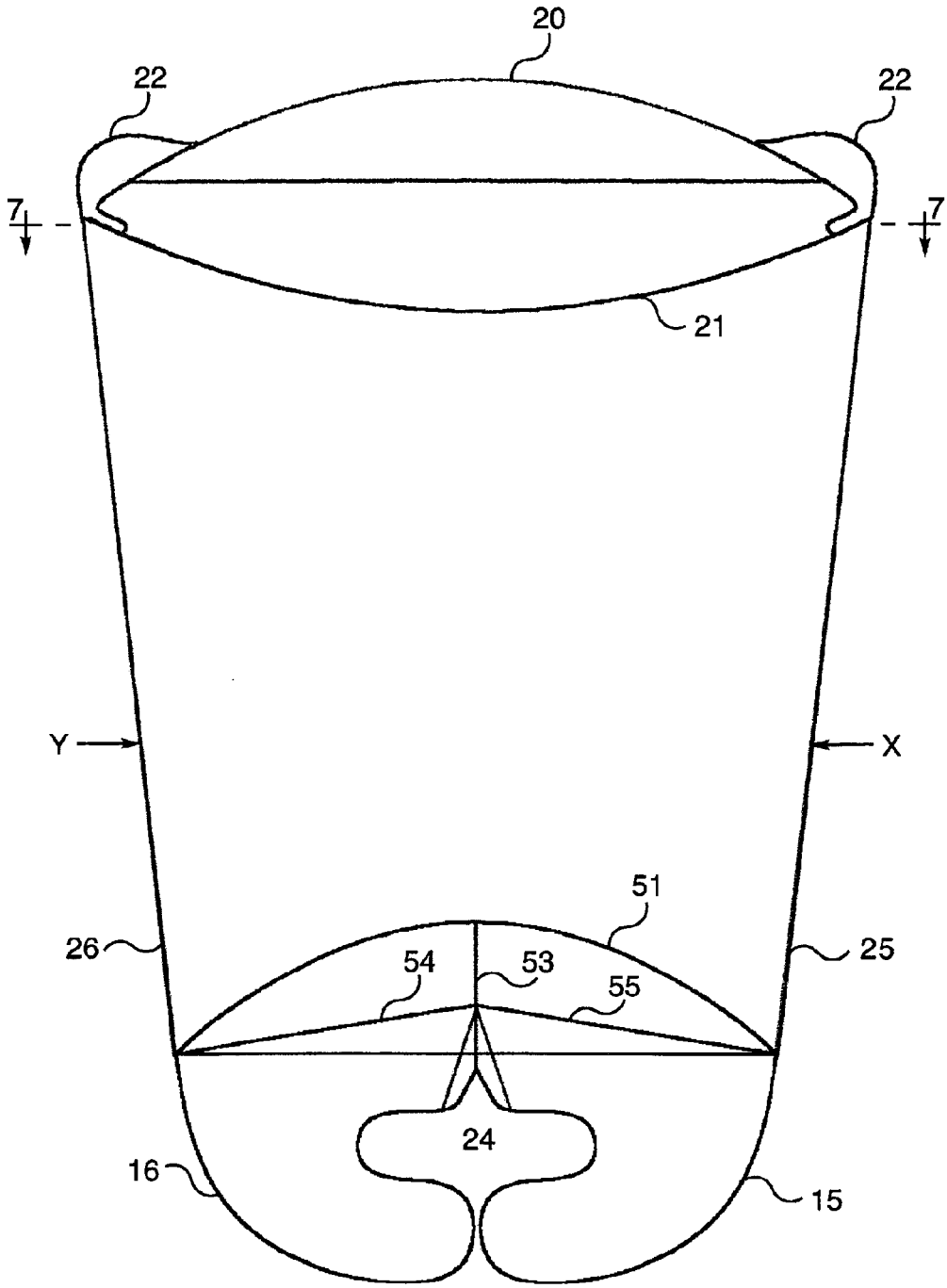
FIG. 3 is a top view of a receptacle in its near flat configuration.

FIG. 2 is a bottom view of the receptacle in its near flat configuration. FIG. 3 is a top view of the receptacle in its near flat configuration. Item 20 is a flap which is attached to wall 5 along arcurate score line 21. Item 22 is a scoop which is attached to wall 4 along arcurate score line 23. Edges 26 and 25 of the receptacle are tapered with respect to the axis running longitudinally through the center of the receptacle. The angle A of this taper, shown in FIG. 2, is preferably between 3 degrees and 9 degrees.

Figure 4:
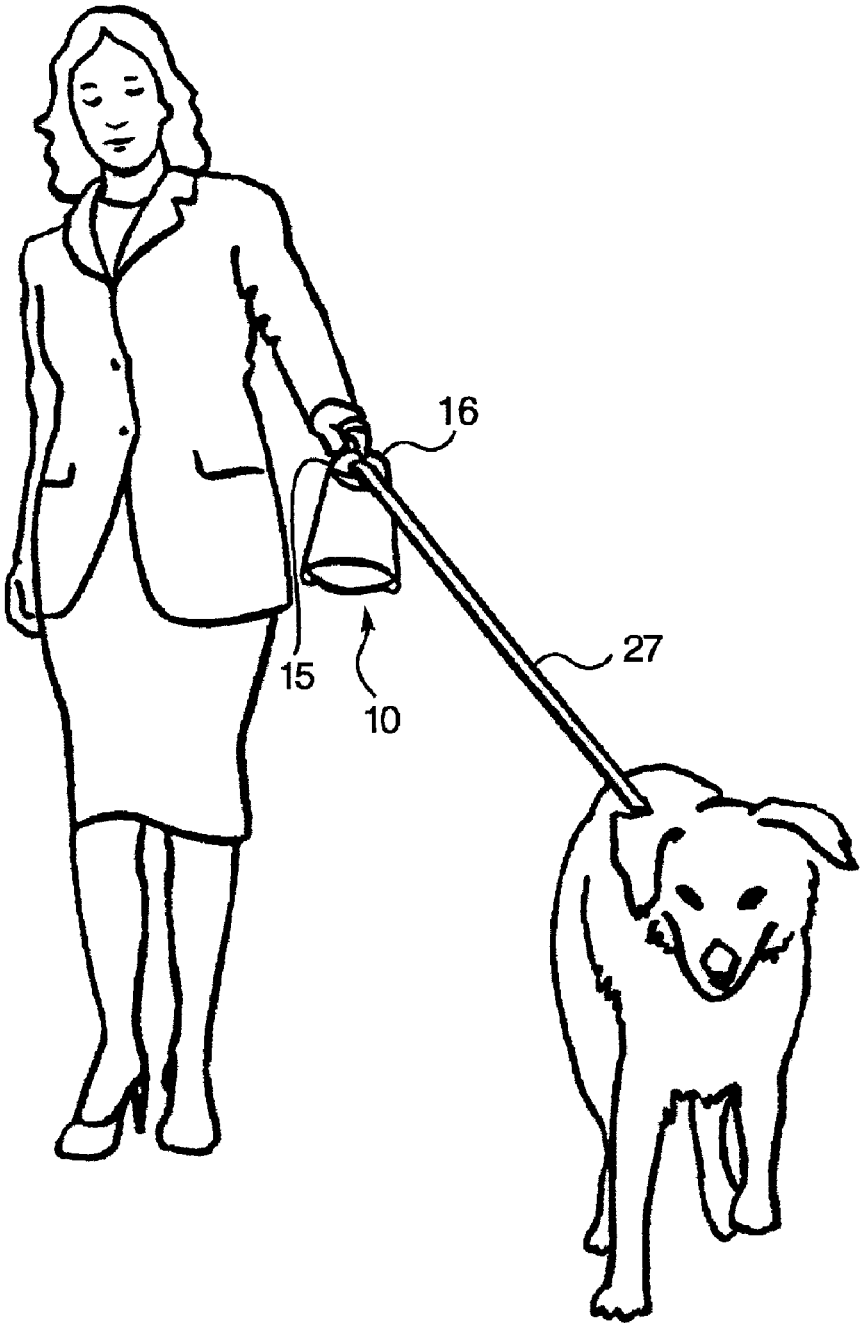
FIG. 4 is a view of a receptacle attached to a dog leash.

In this flat configuration, the hooks items 15 and 16 may be used to attach the receptacle to various articles especially for transport. For instance the hooks may be snapped over portions of the dog leash. See FIG. 4 where a receptacle item 10 is attached by hooks 15 and 16 to dog leash 27. The double layered hooks are flexible enough to allow, for instance, a leash part to be slipped into the space denoted by item 24 between hooks 15 and 16. At the same time, they are rigid enough to prohibit the receptacle from falling off the leash but not so rigid as to prohibit a user from easily pulling the receptacle off the leash for use.

As stated before, the receptacle is normally stored and transported in its near flat configuration. To use the receptacle, it is only necessary to apply pressure along edges 25 and 26 such as at point X and at point Y. Such pressure will normally be applied by a hand of the user. The hand would be placed over the top of the receptacle, that is over wall 5 of the receptacle in its near flat configuration as illustrated for instance in FIG. 3 and FIG. 5. The thumb would be positioned to apply pressure along one of edges 25 or 26 as at point X or Y and the fingers would be correspondingly positioned along the opposite edge. By simply squeezing the edges of the receptacle and thereby applying pressure at points such as X and Y, the edges 25 and 26 of the receptacle will move closer together. This action will cause walls 4 and 5 to bow out, moving away from each other and becoming more curved, and creating an inner space within the receptacle. At the same time flap 20, which is attached to wall 5 at score line 21, will snap down into a position over the end of the receptacle and form a partial wall enclosing the space created within the receptacle.

Figure 5:
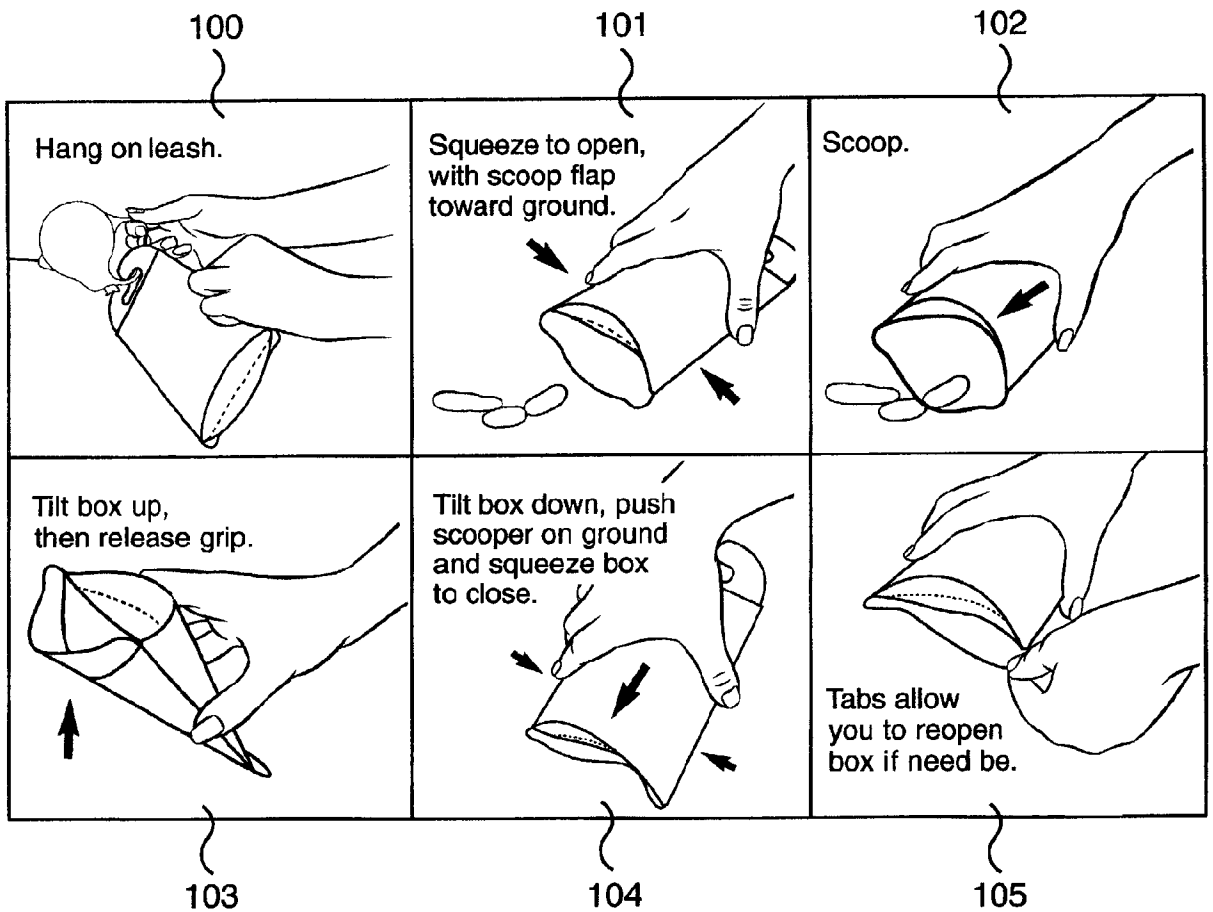
FIG. 5 is an illustration to show how a receptacle may be used.

FIG. 5 is a stylized diagram provided to show possible steps in using the receptacle. Block 100 shows the receptacle attached to the handle portion of a type of commonly used leash. Block 101 shows the receptacle after pressure has been applied to the sides (edges) causing the receptacle to open-up and flap 20 to snap down, placing the receptacle in a configuration ready for use.

Block 102 shows the receptacle being used to scoop-up waste. Block 103 shows the receptacle after the waste has been scooped. The receptacle has been tilted upwards to allow the waste to fall down into the central area of the receptacle. The user then releases the pressure applied to the edges of the receptacle. That release of pressure allows the flap to snap back down covering the opening to the space inside the receptacle and blocking the waste inside the receptacle. Block 105 shows the receptacle after the scoop portion has been pushed down against the rigid object such as the ground. That action causes the scoop to move up, rotating about its score line 23. Subsequent pressure applied to the edges of the receptacle causes the scoop to rest against flap 20 further blocking exist of the waste from the receptacle.

Block 105 shows how the box can be reopened by grasping the tab portions on the ends of the scoop. On occasion a dog will make a second deposit. In this event, the user of the receptacle may want to reopen the receptacle to scoop-up the extra deposit. These tabs enable users to easily do so if they desire. This reopening eliminates the necessity for use of a whole new receptacle.

Figure 7A:
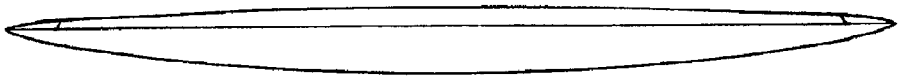
FIGS. 7A, 7B, 7C and 7D are views of a section of the receptacle from FIG. 3.
Figure 7B:
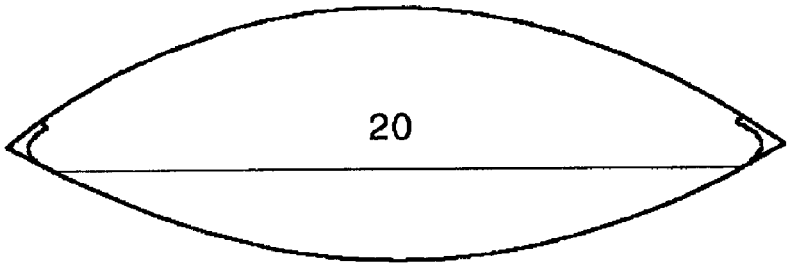
Figure 7C:
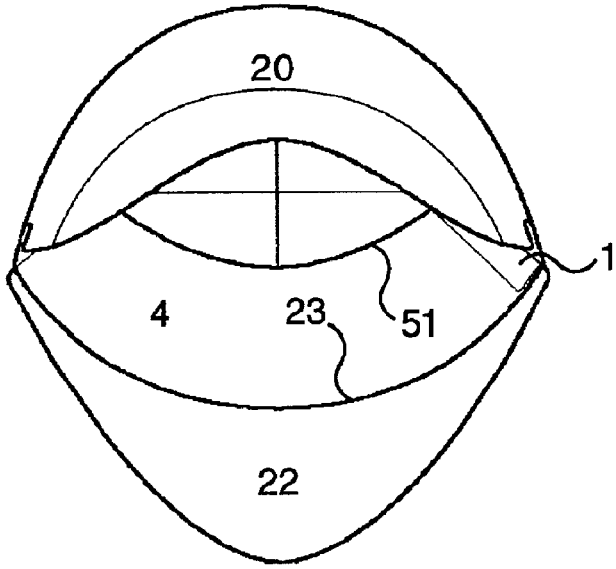

FIG. 7A is a view of a section of the receptacle taken along line 7—7 in FIG. 3. It shows the view when the receptacle is in its near flat configuration. FIG. 7B is a view from the same location after sufficient pressure has been applied at point X and point Y to cause flap 20 to snap down. That is, FIG. 7B shows the top flap item 20 in its snapped down position after the pressure has been applied and released and the inherent bias in the receptacle is holding the front edge of flap 20 in contact with the inner side of wall 4. FIG. 7C is a view at the same location when additional and greater pressure is applied at points X and Y. The additional pressure causes flap 20 to pivot about score line 21 moving inward toward the center of the receptacle and upwards toward the inner side of wall 5. At this juncture the additional pressure at points X and Y causes bottom wall 4 to become more curved and creates an opening between bottom wall 4 and flap 20. The curvature of Scoop 22 in this configuration will follow the curvature of wall 4.

In this configuration, the scoop is ideally shaped to scoop-up excrement. By selectively applying greater or less pressure at points X and Y, the user of the receptacle can vary and control the size of the opening.

Figure 7D:
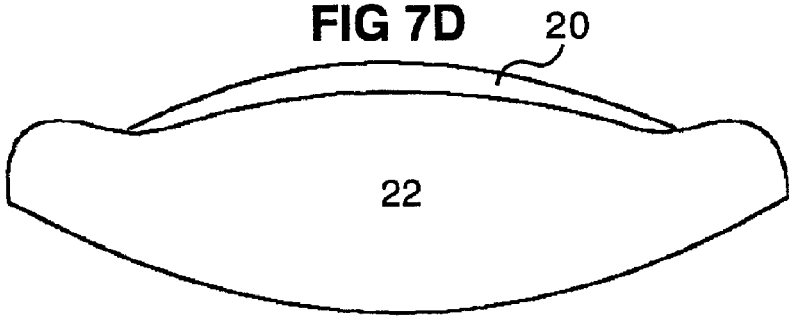

FIG. 7D is a view at the same location, that is, along line 7—7 of FIG. 3, after the pressure has been released causing flap 20 to return to its position shown in FIG. 7 and the scoop 22 has been folded-up.

Figure 9:
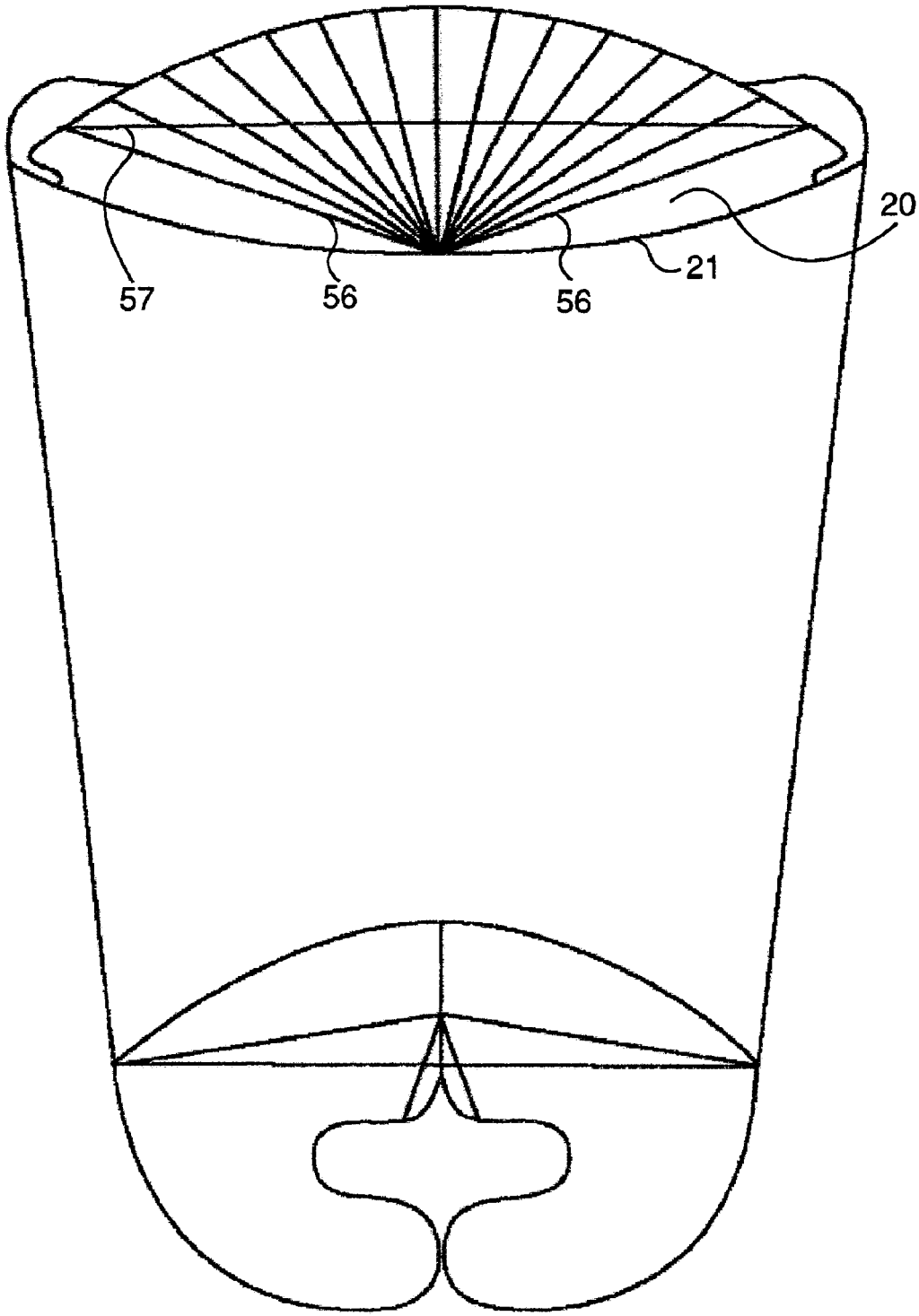
FIG. 9 is a view of a second embodiment of the receptacle in its near flat configuration.

FIG. 9 shows a second embodiment of the receptacle. This embodiment is the same as that shown in FIGS. 1, 2 and 3 except for the addition of score lines 56 on flap 20. As can be seen from FIG. 9 the score lines 56 radiate from the area of a point in the center of score line 21, in a fan shaped pattern across flap 20. As in the first embodiment, line 57 is also a score line.

Figure 11:
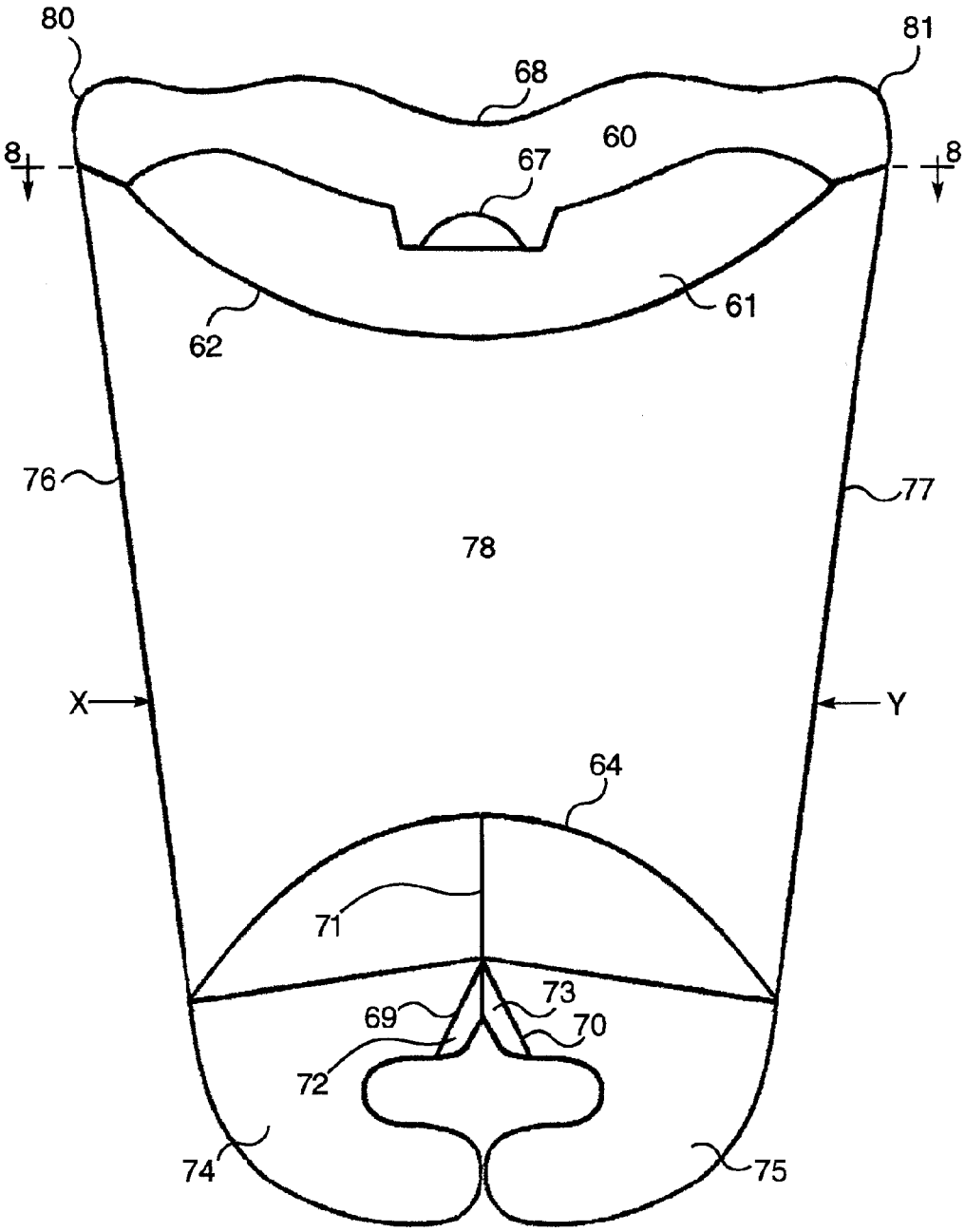
FIG. 11 is a top view of the third embodiment in its near flat configuration.

FIG. 10 is a blank for a third embodiment of the receptacle. The arcurate score lines 62, 63, 64 and 65 of the FIG. 10 embodiment are more arched than corresponding arcurate score lines 21, 23, 51 and 50 of the embodiment of FIG. 1. This increased arching allows the walls to separate a greater distance and gives the receptacle more capacity for the amount of material used. Of particular significance is that the flap 20 of FIG. 1 has been replaced with flap 61 in FIG. 10 and scoop 22 of FIG. 1 has been replaced by scoop 60 in the FIG. 10 embodiment. FIG. 11 is a top view of the third embodiment of the receptacle after the blank of FIG. 10 has been folded and glued in the manner as previously described in connection with the first embodiment. The receptacle as depicted in FIG. 11 is in its near flat configuration. Lines 69, 70 and 71 are score lines. These score lines define regions 72 and 73 on hooks 74 and 75. When pressure is applied to the side edges 76 and 77 of the receptacle items 72 and 73 bend along lines 69 and 70 and fold about line 71. This action allows hooks 74 and 75 to move inwards towards each other and to overlap.

Figure 12:
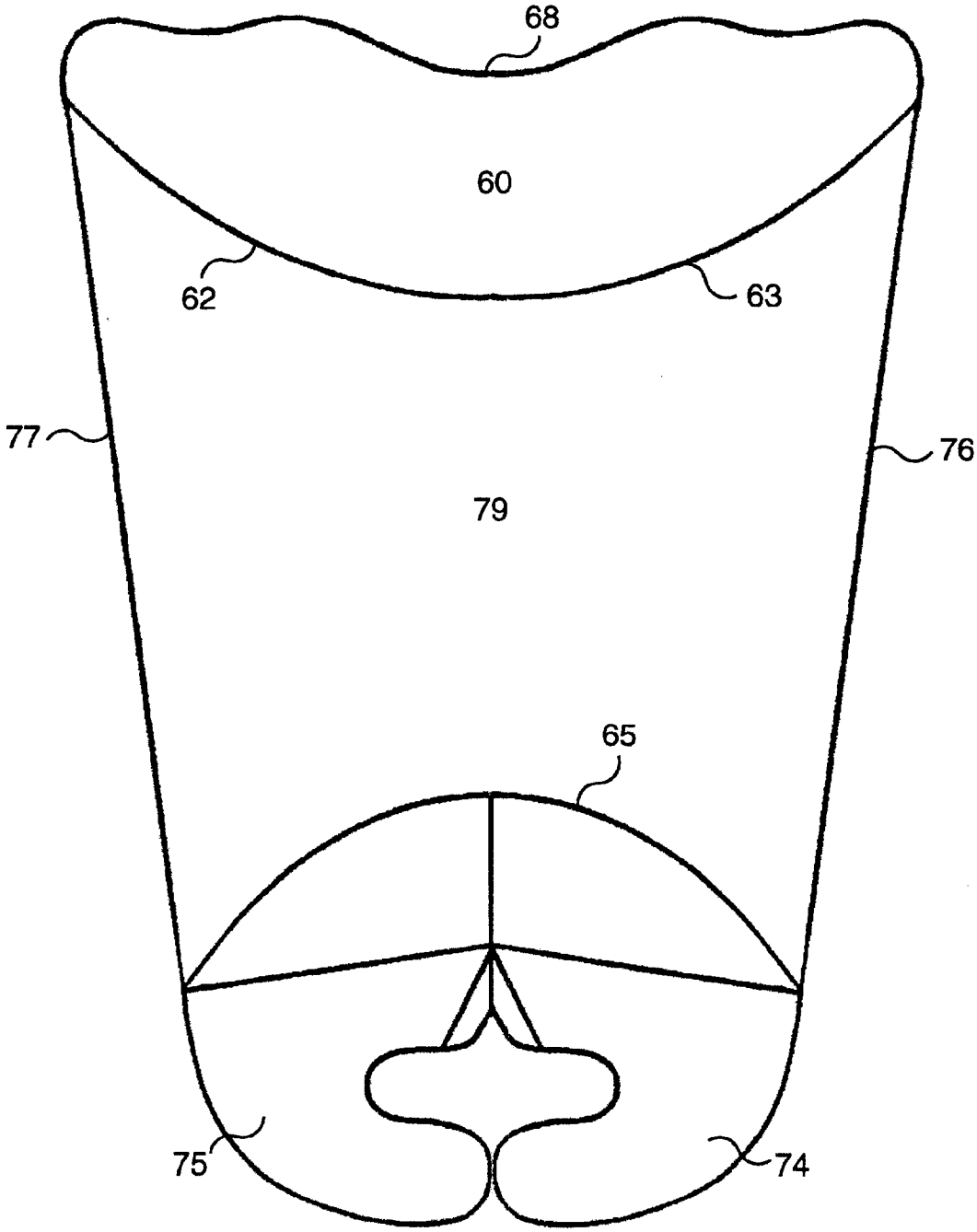
FIG. 12 is a bottom view of the third embodiment of the receptacle in its near flat configuration.

FIG. 12 is a bottom view of the embodiment of the receptacle made from the blank of FIG. 10 and shown in its near flat configuration.

Figure 8A:
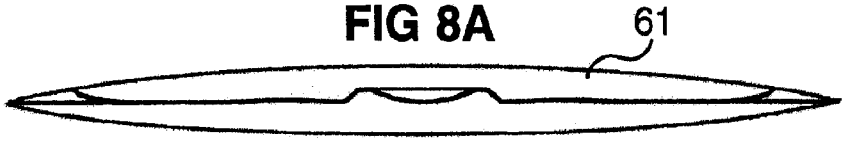
FIGS. 8A, 8B, 8C and 8D are views of a section of a third embodiment of the receptacle.
Figure 8B:
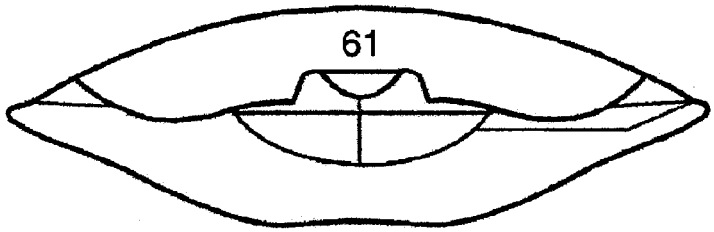
Figure 8C:
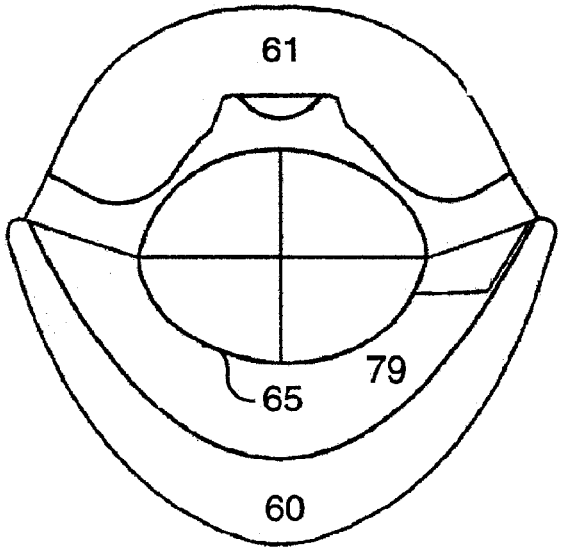

FIG. 8A is a section view of FIG. 11 along section line 8—8. FIG. 8A shows the third embodiment in its near flat configuration. FIG. 8B is a view from that same location after sufficient pressure has been applied to edges 76 and 77 to cause flap 61 to snap down. FIG. 8C is a view at the same location when additional and greater pressure is applied along the edges of the receptacle. The additional pressure causes flap 61 to pivot about score line 62 moving inward toward the center of the receptacle and upwards toward the inner side of wall 78. Exerting additional pressure along edges 76 and 77 causes bottom wall 79 to become more curved and creates a larger opening between bottom wall 79 and flap 61. The curvature of scoop 60 in this configuration will follow the curvature of wall 79. In this configuration, the scoop is shaped to facilitate efficient scooping-up of excrement and the receptacle is opened wide with space created to receive and hold the excrement. By selectively applying greater or lesser pressure along the edges 76 and 77 the user of the receptacle can vary and control the curvature of the scoop and control the size and shape of the opening into the interior of the receptacle.

Figure 8D:
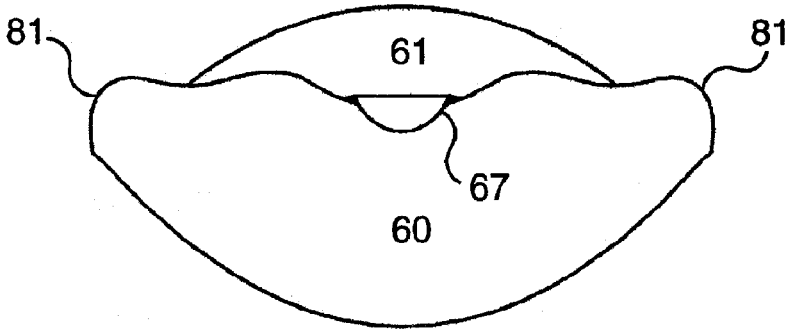

Once the receptacle is loaded with the excrement or whatever else the user desires to place inside the receptacle, it will normally be desirable to close the opening to the receptacle. This closing can be started by applying some force to the bottom side of the scoop 60 such as by pushing the scoop against the ground. This action causes the scoop to pop into a position where it is no longer in the same plane with wall 79 but has pivoted upwards about score line 63. Once scoop 60 is in at least such a partially folded-up position, the application of further pressure to the side edges 76, 77 of the receptacle will cause scoop 60 to further rotate up and inwards towards the center of the receptacle, pivoting about score line 63. That same pressure will cause flap 61 and in particular, tab 67 on flap 61 to arch up in a position above area 68 on scoop 60. By a controlled application of pressure with one hand, the scoop area 68 and the tab 67 can be aligned so that subsequent release of pressure will cause tab 67 to interlock with area 68 on the scoop 60 thus blocking the exit from the receptacle. This closure of the receptacle is best illustrated in FIG. 8D which is a view at the same location as in FIG. 8A but after scoop 60 has been folded-up.

Figure 6A:
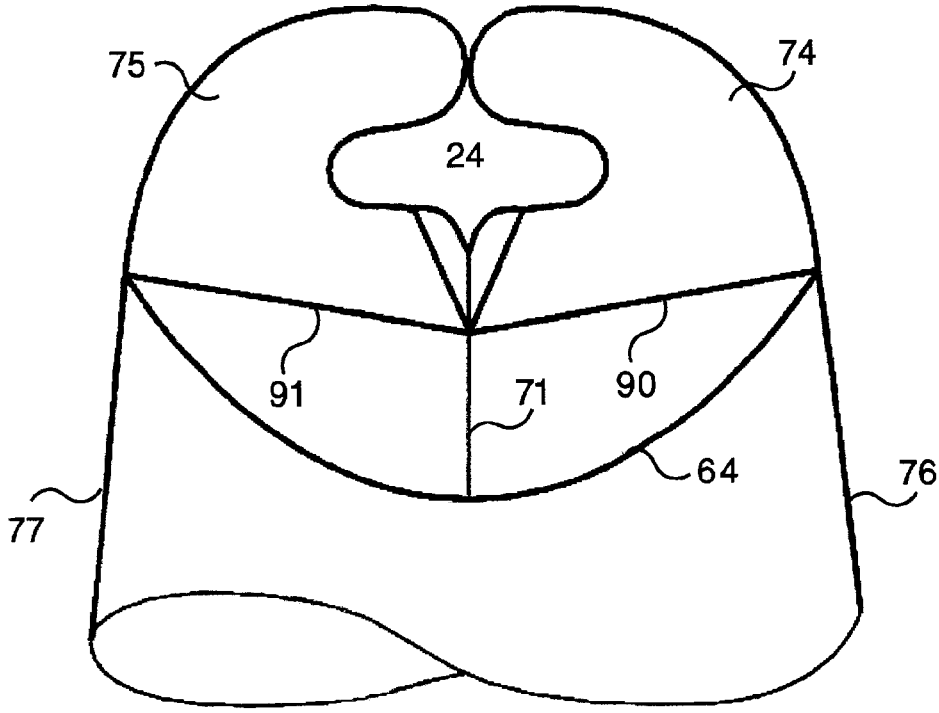
FIGS. 6A and 6B are views of the hanger of the receptacle.
Figure 6B:
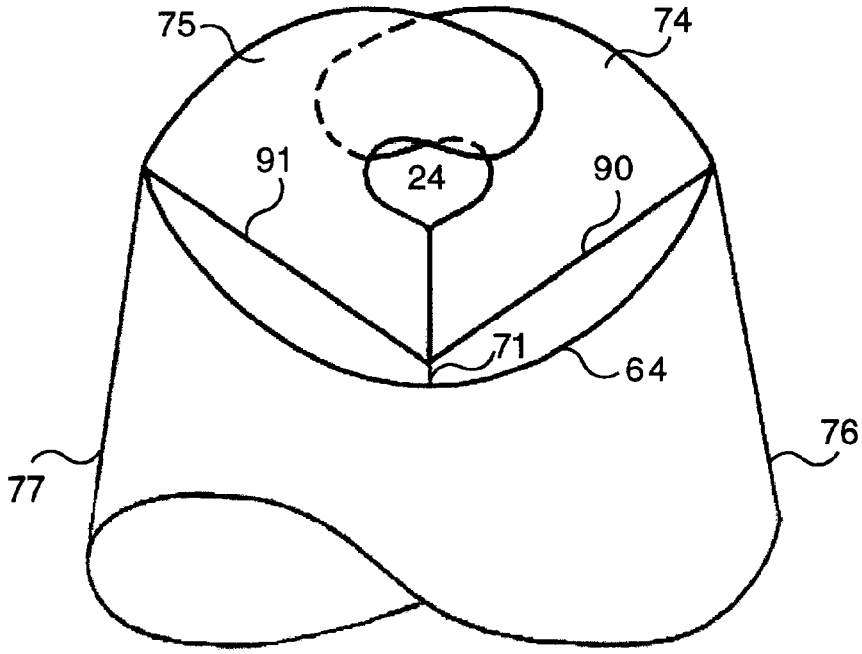

FIGS. 6A and 6B illustrate a portion of the receptacle showing the hooks 74 and 75. FIG. 6A shows the hooks when the receptacle is in its near flat configuration. FIG. 6B shows the same hooks after pressure is applied to the side edges of the receptacle. That pressure causes the edges of the receptacle to move closer together. When the edges move closer together the walls 78 and 79 of the receptacle bow-out and move farther apart. However, items 110 and 111, see FIG. 10, are adhered together to form hook 74 so items 110 and 111 cannot move father apart even though force is being exerted upon them by walls 78 and 79. Also, items 112 and 113 cannot move farther apart even though force is also being exerted upon them. Line 71 in FIG. 6A is a score line. When walls 78 and 79 bow-out the material between score line 64 and hooks 74 and 75 and the material between score line 65 and hooks 74 and 75 is pulled inward towards the central interior portion of the receptacle. The resulting configuration is like that illustrated in FIG. 6B. In FIG. 6B, it can be seen how the lower edges items 90 and 91, in FIG. 10 have been pulled in towards the central portion of the receptacle and how the hooks have overlapped.

Figure 13:
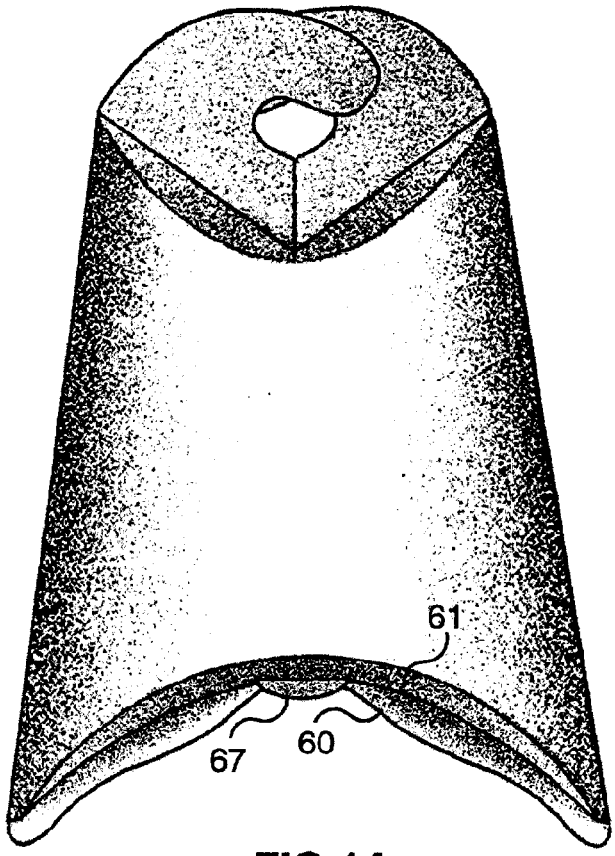
FIGS. 13, 14 and 15 are top, end and side views respectively of a third embodiment of a receptacle after it has been expanded and the end closed.
Figure 15:
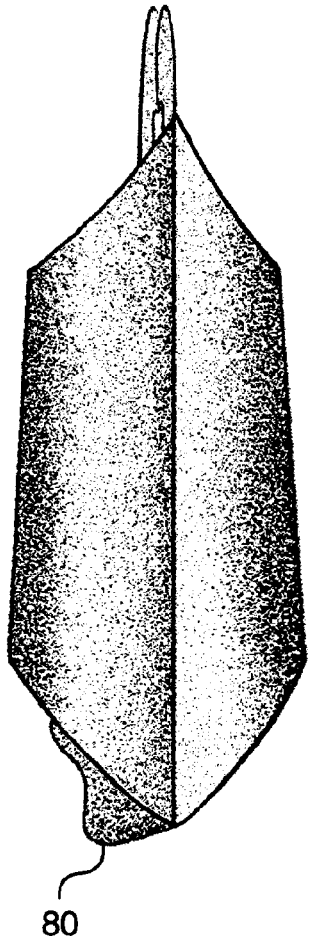
Figure 14:
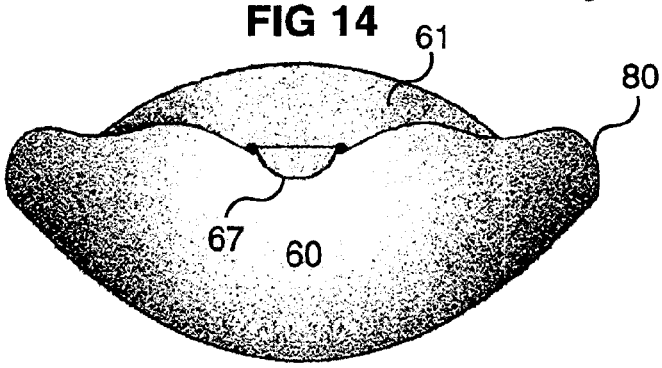

FIG. 13 is an illustration to give an idea of how the third embodiment will look from a top view after sufficient pressures have been applied along edges 76 and 77 to cause the walls 78 and 79 to bow-out. That bowing action also caused hooks 74 and 75 to overlap and flap 62 to snap down. Also scoop 60 in this view has rotated upwards and interlocked with flap 61. Tab 67 on flap 61 has snapped over area 68 of scoop 60. These features are better shown in FIG. 14 which is an illustration of a front view of the third embodiment with flap 61 and scoop 60 closed and interlocked blocking exist of waste material from the central portion of the receptacle. FIG. 15 is a side view of the third embodiment in the same configuration as in FIGS. 13 and 14. Note how tab 80 of scoop 60 is available for grasping by a human hand to reopen the receptacle by pulling out and down on tab 80.

Figure 16:
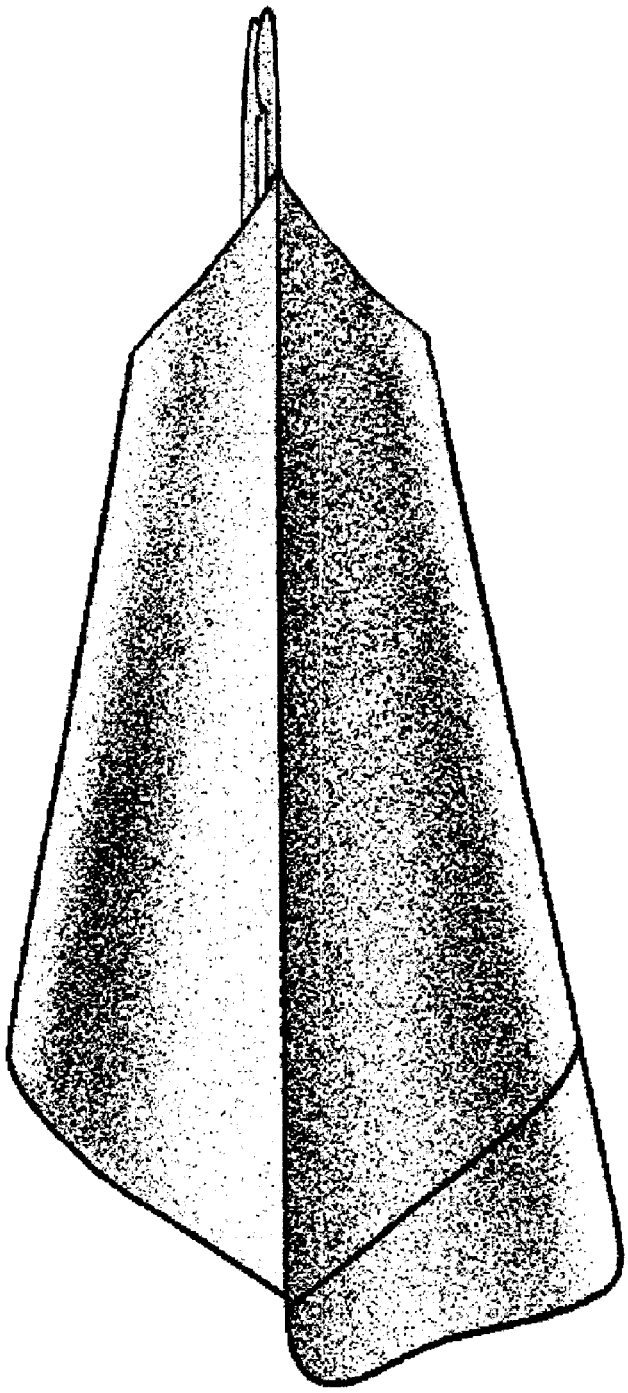
FIG. 16 is a side view of a third embodiment of the receptacle expanded and with the scoop down and in a position ready for scooping.

FIG. 16 is a side view of a receptacle with the scoop down and in a condition ready for scooping-up waste. The flap is down also and inside and therefore not viewable in this figure.

It should be understood that while the drawings contained herein are illustrative of the invention, the precise curvatures of the receptacle in its various expanded configurations is not only a function of the pressures applied but of the relative flexibility and resiliency of the particular thin sheet material used.

The receptacle can also be directly formed using plastic. When this is done, the device would be injection molded or blow molded directly into a finished receptacle made of plastic. There would be no blank. The blank, the glue flap, the folding and the gluing process would be eliminated. The device would look and function in a similar manner to the other disclosed embodiments.

While this invention has been disclosed in connection with what is presently considered to be the preferred embodiments, it should be understood that the invention is not limited to the disclosed embodiments but is intended to cover various modifications and equivalent arrangements included within the spirit and scope of the appended claims.

I claim:

1. A waste receptacle comprising:

a first thin wall and a second thin wall, said first wall having a first side and a second side, said first and second sides being of substantially equal length, said second wall having a first side and a second side, the said first side of said first wall being connected to the said first side of said second wall along a fold line, the said second side of said first wall being joined with the said second side of said second wall so that said first and second walls are connected along a junction line, said first wall having a flap joined to it at a third side along a score line, said score line having an arcurate shape;

said receptacle being responsive to a first application of pressure at said fold line and at said junction line to cause a space to be created between said first wall and said second wall for receipt of waste products and to cause said flap to snap into a position at least partially blocking an external opening to said space; and said receptacle being responsive to subsequent application of pressure at said fold line and at said junction line to control the position of said flap in said opening.

2. A waste receptacle as in claim 1 further comprising a second flap joined at a third side of said second wall along a score line said second flap being operable to be folded over said first flap.

3. A waste receptacle as in claim 1 further comprising a hook structure connected at a fourth side of said first wall.

4. A waste receptacle as in claim 1 wherein said first wall has a tapered shape.

5. A waste receptacle as in claim 3 wherein said hook structure further comprises a first hook and a second hook.

6. A canine waste receptacle comprising:

a body section having an internal space for containing waste;

a scoop connected at a first end of the said body section for use in scooping said waste into said internal space; and a hook having an open end at a second end of said body section for attaching said receptacle to external objects.

7. A receptacle as in claim 6 wherein the said hook comprises a first hook and a second hook and the first hook is operative to be moved into a position so that it at least partially overlaps said second hook.

8. A receptacle as in claim 6 wherein the entire receptacle is formed from a single sheet of material.

9. A receptacle for waste comprising:

a central body portion having a first wall and a second wall, said first wall being attached at a first side to a first side of said second wall defining a first edge of said central body, said first wall being attached at a second side to a second side of said second wall defining a second edge of said central body;

said central body having a first end and a second end;

a scoop attached to said central body at said first end;

and a hanger including a hook having an open end attached to said central body at said second end.

10. A receptacle as in claim 9 wherein said scoop is attached to said central body along an arcurate score line.

11. A receptacle as in claim 9 wherein said hanger is attached to said central body along an arcurate score line.

12. A receptacle as in claim 9 wherein said hook includes a first hook and a second hook and the relative position of said first hook with said second hook is controllable by the application of pressure to said first edge of said central body and to said second edge of said central body.

13. A receptacle as in claim 12 wherein the receptacle is configured so that pressure may be applied to said first edge of said central body and to said second edge of said central body by a single human hand.

14. A receptacle as in claim 9 wherein said scoop has a tab formed at a first position for movement of the scoop by a human hand.

15. A receptacle as in claim 9 further including a flap with a tab attached to said first end, said tab being operable to interlock with said scoop.

16. A receptacle as in claim 9 wherein one of said first wall and said second wall is slightly wider than the other of said first wall and said second wall.

17. A receptacle as in claim 9 where the entire receptacle is formed from a single continuous blank, said blank being made of sheet material.

18. A receptacle as in claim 17 wherein the said material is cardboard.

19. A receptacle as in claim 9 further including a flap connected to said central body at said first end; and said receptacle being responsive to a first application of pressure on said first edge and on said second edge to cause enlargement of a space between said first wall and said second wall for receipt of waste product and to cause said flap to snap into a position at least partially blocking an external opening to said space.

20. A receptacle as in claim 9 wherein said scoop is hinged to the body portion along a score line and said scoop is operable to be moved about said score line by the application of pressure on the said first edge and the said second edge of said central body.

21. A canine waste receptacle comprising:

a central body portion having a first wall and a second wall where a first side of said first wall is connected to a first side of said second wall along a line defining a first edge and a second side of said first wall is connected to a second side of said second wall along a line defining a second edge and the width of said first wall measured from a first point along said first edge to a second point along said second edge is slightly greater than the width of said second wall measured from said first point to said second point;

a scoop formed at a first end of said first wall; and a hook having an open end formed at a second end of said first wall.

22. A canine waste receptacle as in claim 21 wherein a receptacle is made of plastic.

23. A waste receptacle comprising:

a first wall and a second wall;

a first side of said first wall being connected to a first side of said second wall along a first line;

a second side of said first wall being connected to a second side of said second wall along a second line;

a flap connected to a third side of said first wall along a score line said score line having an arcurate shape;

said receptacle being responsive to a first application of pressure at said first line and at said second line to cause said receptacle to go from a near flat configuration to a configuration having a space between said first wall and said second wall for receipt of waste product and to cause said flap to snap into a position at least partially blocking an external opening to said space; and said receptacle being responsive to subsequent application of pressure at said first line and at said second line to change the position of said flap in said opening.

24. A waste receptacle as in claim 23 further comprising:

a scoop connected to a third side of said second wall along a second score line said second score line having an arcurate shape.

25. A waste receptacle as in claim 24 wherein said scoop is operative to be rotated about said second score line so that the scoop at least partially blocks said external opening.

26. A waste receptacle as in claim 24 including means for interlocking said flap and said scoop to block the said external opening.

27. A waste receptacle as in claim 23 wherein said first wall has a tapered shape and said second wall has a tapered shape.

* * * * *